United States Patent [19]

Manos et al.

[11] 4,258,837

[45] Mar. 31, 1981

[54] TIMER CIRCUIT FOR VENDING MACHINE

[75] Inventors: Thomas Manos, Worcester; Craig Self, Ashland, both of Mass.

[73] Assignee: Jet Spray Cooler, Inc., Waltham, Mass.

[21] Appl. No.: 959,101

[22] Filed: Nov. 9, 1978

[51] Int. Cl.[3] ..... G07F 5/16; G06F 7/38

[52] U.S. Cl. ..... 194/1 N; 194/9 T; 194/10; 235/92 PE

[58] Field of Search ..... 194/1 L-1 N, 194/9 R, 9 T, 10, 2, DIG. 1, DIG. 3, DIG. 18; 235/92 CN, 92 T, 92 CC, 92 BN, 92 PE, 92 CT

[56] References Cited

U.S. PATENT DOCUMENTS

| | | | |
|---|---|---|---|
| 3,428,157 | 2/1969 | Patterson et al. | 194/2 |
| 3,478,855 | 11/1969 | Seversen | 194/9 R |
| 3,508,636 | 4/1970 | Shirley | 194/10 |
| 3,604,903 | 9/1971 | Hill et al. | 235/92 CC X |
| 3,791,505 | 2/1974 | Mandell | 194/10 |
| 3,820,642 | 6/1974 | Levasseur | 194/1 N |

*Primary Examiner*—Robert J. Spar
*Assistant Examiner*—Edward M. Wacyra
*Attorney, Agent, or Firm*—Wolf, Greenfield & Sacks

[57] ABSTRACT

The circuit includes a switch array for setting two conditions, one for defining the length of the vend period and the other for defining the coinage necessary to initiate the vend period. A binary counter is coupled by the switch array to a decoder circuit, and the binary counter is first counted incrementally in response to coinage insertion until the correct coinage has been received at which time the counter is enabled to continue counting through a timing cycle defining the vend period. At the end of the vend period the circuit is reset for future usage.

18 Claims, 1 Drawing Figure

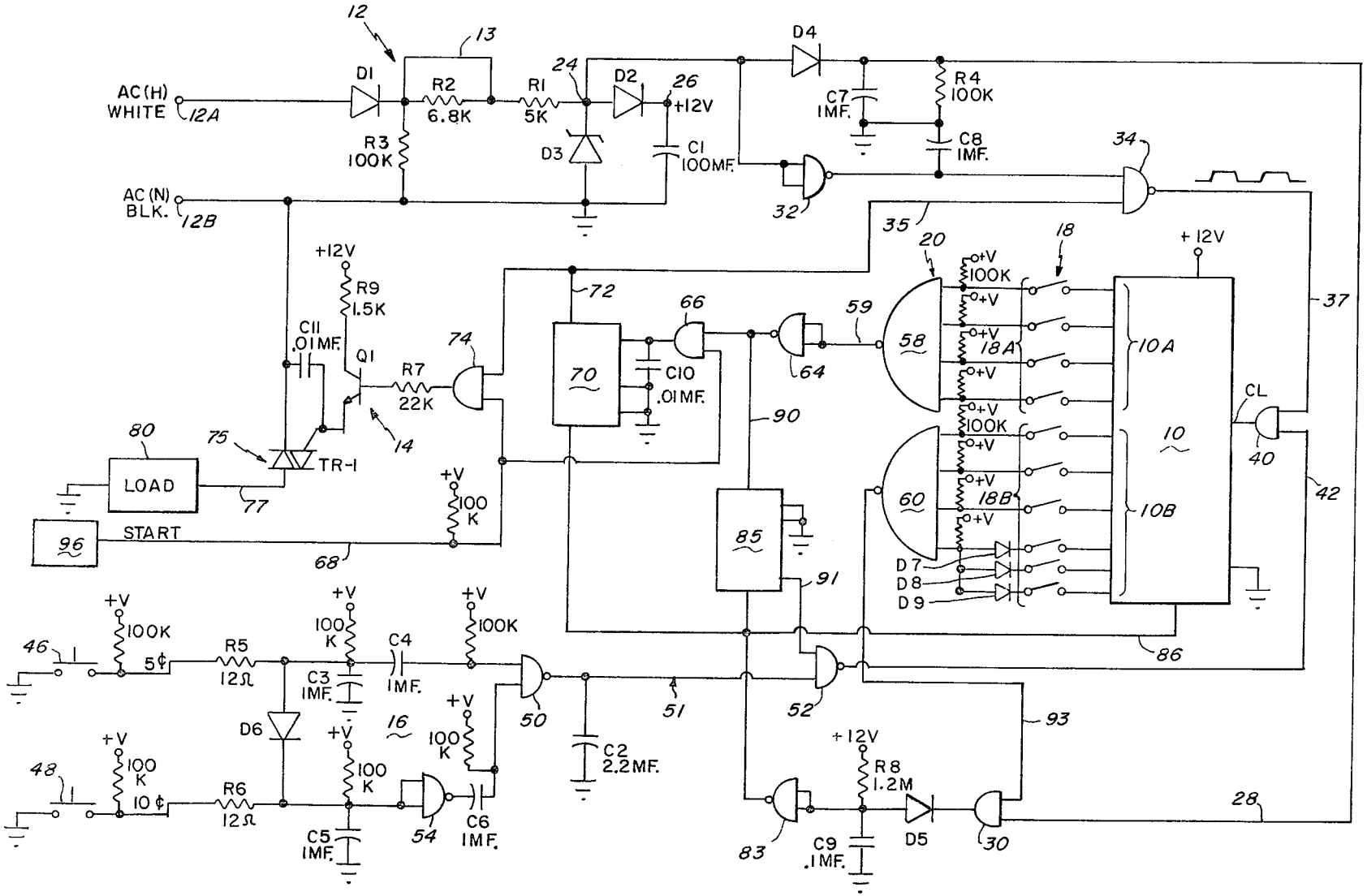
AC (H) WHITE
AC (N) BLK.
LOAD
START
+12V
R1 5K
R2 6.8K
R3 100K
R4 100K
R5 12Ω
R6 12Ω
R7 22K
R8 1.2M
R9 1.5K
C1 100MF.
C2 2.2MF.
C3 1MF.
C4 1MF.
C5 1MF.
C6 1MF.
C7 1MF.
C8 1MF.
C9 .1MF.
C10 .01MF.
C11 .01MF.
D1
D2
D3
D4
D5
D6
D7
D8
D9
Q1
TR-1
CL
10
10A
10B
18
18A
18B
58
60
70
85
96

TIMER CIRCUIT FOR VENDING MACHINE

BACKGROUND AND SUMMARY OF THE INVENTION

The present invention relates in general to a solidstate timing circuit, and pertains, more particularly, to a timer circuit for a vending machine which may be programmed to operate on different coinage values and which further can be programmed to operate a vending machine through different length vending periods. In the disclosed embodiment of the present invention the machine may be operated on coinage of 5 cent or 10 cent denomination up to a total of 75 cents. The vend period is also settable and usually on the order of seconds.

One object of the present invention is to provide an improved timer circuit for a vending machine. The circuit of this invention is preferably for vending machine that vends a liquid such as a soda or fruit juice.

Another object of the present invention is to provide an improved timer circuit for a vending machine that is essentially tamper-proof. In some known circuitry the vending period can be initiated by interrupting power to the machine. However, in accordance with the present invention this circuitry is adapted to prevent any operation of the vending machine by selective temporary power interruption.

Still another object of the present invention is to provide an improved timer circuit for a vending machine that is easily adapted for use with either 110 VAC or 220 VAC input power.

A further object of the present invention is to provide an improved timer circuit preferably for a vending machine and which is of relatively simple construction requiring a minimum number of components and which can be made quite inexpensively.

To accomplish the foregoing and other objects of this invention there is provided a circuit that includes a counter having first and second counter sections (fields) with one section corresponding to coinage necessary to initiate the vend period and the other section associated with the time of termination of the vend period which of course relates to the length thereof. The counter is preferably a binary counter having an input means usually in the form of a clock input for incrementing the counter and output lines usually a plurality being associated with each section of the binary counter. The counter is counted through a first phase until a count is received corresponding to the proper coinage and thereafter the counter is continuously clocked until a second count is received through a second phase of operation representative of the vend period.

In addition to the counter, the circuit of this invention also comprises an input coinage circuit responsive to the insertion of coinage into the machine for generating a signal coupled to the counter for incrementing the counter. In the disclosed embodiment both 5 cent and 10 cent pieces operate the counter with the insertion of each 5 cent piece creating one pulse and the insertion of each 10 cent piece generating two pulses to increment the counter. The output of the circuit of this invention may comprise a circuit means such as a triac for operating a load during the vend period. The load may typically be a motor for operating an auger for dispensing a drink powder. The load usually also includes a solenoid for operating the water associated with the drink. A first settable decoder means couples from the output lines of the first section of the counter for providing a signal for initiating the vend period of the circuit means. Also, there is provided a second settable decoder means coupled from output lines of the second section of the counter for providing a signal terminating the vend period of the circuit means. Both settable decoder means comprise a switch array that is preset with one portion of the array preset for the coinage and the other portion preset for defining the duration of the vend period. The circuit of this invention preferably also includes a power supply, reset circuitry, and circuitry for preventing erroneous operation of the vending machine.

DESCRIPTION OF THE DRAWING

Numerous other objects, features and advantages of the invention should now become apparent upon a reading of the following detailed description taken in conjunction with the accompanying drawing which is a circuit schematic diagram of a preferred embodiment of the timer circuit of the present invention.

DETAILED DESCRIPTION

In the drawing the preferred circuit comprises a binary counter 10, power supply 12, output circuit 14, coinage circuit 16, switch array 18, and decoder circuit 20. The circuit of this invention may be powered from either 110 VAC or 220 VAC. This input AC power is connected at terminals 12A and 12B which are the input terminals to the power supply 12. Line 12B may be considered as the common ground line. The sinusoidal input signal couples by way of diode D1 and resistors R1, R2 and R3 to the Zener diode D3. A jumper 13 is also provided across resistor R2. This jumper is provided on all circuits which adapts them to 110 VAC inputs. If the circuit is to be used with 220 VAC then the jumper is 13 is simply removed, thereby incorporating resistor R2 in the circuit. The power supply also includes diode D2 and capacitor C1.

With regard to the power supply 12, the voltage at node 24 is a half wave rectified signal that is also clipped to an approximate 12 volt level by the Zener diode D3. This voltage when coupled by way of the diode D2 to the capacitor C1 becomes a substantially DC voltage at node 26. This voltage is typically +12 volts and is the voltage that may be used with the electronic circuits shown in the diagram such as the binary counter 10 which operates on this voltage and ground.

The waveform at node 24 is also coupled by way of diode D4 to the parallel combination of capacitor C7 and resistor R4. The time constant of the circuit including capacitor C7 and resistor R4 is relatively short on the order of 100 milliseconds so as to provide a reset pulse at power-up even if the power input is very temporary. This circuit will be discussed in more detail hereinafter with reference to the operation of the overall circuit.

Under normal operation, the voltage at node 24 coupled by way of diode D4 provides a relatively constant voltage on the line 28. This voltage is coupled to the AND gate 30 as one input thereto. The voltage at the node 24 also couples by way of inverter 32 to one input of the NAND gate 34. This input to the gate 34 is essentially a pulsed input which, when enabled by way of a signal on line 35, provides clock pulses on line 37 to the AND gate 40. The output of the gate 40 couples to the clock input CL of the binary counter 10. The counter 10 is also clocked by way of the gate 40 from line 42 under control of the input coinage circuit 16.

The circuit 16 has two inputs thereto shown schematically coupling from switches 46 and 48. These switches schematically represent coin slot mechanisms and, for example, when a nickel is inserted into the vending machine, the switch 46 is moved from its open position shown in the drawing to a closed position so as to couple a ground signal into the circuit at resistor R5. With the switch 46 open the capacitor C3 is charged. However, when a coin is inserted the switch, such as switch 46 closes causing capacitor C3 to discharge through the relatively small resistance R5, causing a negative-going pulse to be coupled through capacitor C4 to one input of the NAND gate 50. This low level pulse at the input of gate 50 causes a high level output pulse on line 51 which is in turn passed by NAND gate 52 as a low going pulse on line 42 which functions to clock the binary counter 10 to its next position. Thus, upon insertion of each 5 cent piece into the machine, the capacitor C3 is discharged to provide a pulse coupled through the logic circuitry including gates 50, 52 and 40 to clock the binary counter and move this counter one position.

In the drawing there is also shown the switch 48 which represents the insertion of a 10 cent piece into the machine. When this occurs, the switch 48 is actually closed for a predetermined period of time. Upon initial closure, the diode D6 becomes conductive providing for a discharge of capacitor C3 and the generation of a pluse which occurs at the beginning of closure of switch 48. This pulse is generated in substantially the same manner as the pulse that was generated upon insertion of the 5 cent piece. The 10 cent portion of the circuit is similar to the 5 cent portion with the addition of an inverter 54. At the time that the switch 48 closes, the capacitor C5 discharged causing no pulse to be coupled by way of capacitor C6. However, when the switch 48 again opens there is a positive pulse then at the input to gate 54 which is coupled as a negative pulse by the inverter 54 via capacitor C6 to the other input of NAND gate 50. This negative going pulse at the other input of the gate 50 causes a second clock pulse to the binary counter spaced from the first clock pulse generated by virtue of discharge of capacitor C3 through diode D6.

In summary, the circuit 16 provides a single positive pulse on line 51 for each 5 cent piece and generates a series of two pulses on the same line for each 10 cent piece. It is noted that this feature is also provided with a relatively simple circuit that essentially makes dual use of the 5 cent circuit with the simple addition of a single diode, namely diode D6.

The binary counter 10 is preferably a number 4040 built with C-MOS circuitry. This counter is of conventional design and may be of the type manufactured by many different companies such as Texas Instrument or Motorola. The output of the counter in the application of the present invention may be separated into fields 10A and 10B corresponding respectively, with coinage count and vending period count. The section (field) 10A has associated therewith four switches of the array 18 forming switch group 18A. With regard to section (field) 10B there are six switches of array 18 identified as switch group 18B. The decoder circuit 20 includes NAND gate 58 associated with switch group 18A and NAND gate 60 associated with switch group 18B. In addition, there are provided diodes D7, D8 and D9 which expand the capability of the gate 60 permitting it to function essentially as a six-input NAND gate.

The field 10A of counter 10 represents the least significant bits in comparison to the output from the counter demarcated as field 10B. When the coinage is inserted into the machine as previously explained with reference to circuit 16, the counter 10 is incremented. The switch group 18A is preset with certain ones of the four switches closed and others open. When the counter is incremented to the preset count on the switches, the gate 58 is in its decoded position with all of its inputs at their high level thus providing a low level output on line 59. This low level signal on line 59 is indicative of the receipt of the proper coinage to the machine. The low level on line 59 is inverted by inverter 64 and couples to AND gate 66. Assuming that the start line 68 is also at a high level, the gate 66 has both high inputs and thus its output is high setting the flip-flop 70 which is a 4013 device to its set condition providing a high level signal on its output 72. With a high level signal on both lines 68 and 72 the AND gate 74 is also enabled causing transistor Q1 to become conductive and operate the traic 75 thus providing an AC drive signal by way of line 77 to the load 80. The setting of flip-flop 70 also provides an enabling signal on lines 72 and 35 to the gate 34. Previously, line 35 had been in its low state disabling clock pulses by way of gate 34 to line 37 at gate 40. In other words, during the phase of operation wherein coinage is being registered, the flip-flop 70 is reset and no counting can be provided to the binary counter by way of gate 34 and line 37.

At initial power-up a reset occurs by means of the circuit including resistor R8 and capacitor C9. At power-up there is a high level at the output of inverter gate 83 which causes a resetting of flip-flop 70 and flip-flop 85. Also, by way of line 86 there is a resetting of the binary counter 10 at power-up.

It was found that it may be possible to operate the circuit by temporary removal of the power. Accordingly, to overcome this possibility, a timing circuit including capacitor C7 and resistor R4 has been added to provide a negative-going pulse on line 28. This timing circuit has a relatively short time constant that causes reset upon even brief power removal. When the system is on and there is even a temporary interruption of power, a negative going pulse on line 28 causes a forward biasing of diode D5 which in turn discharges capacitor C9 to provide the resetting.

Under normal operation, when the circuit is initially powered, the circuit including capacitor C9 and resistor R8 resets flip-flops 70 and 85 and also resets the binary counter 10. Thereafter, the coinage is inserted as discussed hereinbefore and the binary counter 10 counts to a comparison count for providing a low level on line 59 to set the flip-flop 70 and commence the vending period which is defined as the period of time that power is provided to the load 80 by way of the triac circuit 75. At the end of this coinage phase of operation there is also provided a signal on line 90 for setting the flip-flop 85 so that its line 91 is in a low state thereby inhibiting gate 52 and preventing any further pulses counting the counter 10 from the circuit 16.

Upon initiation of the vending period the line 35 is also in its high state enablaing the gate 34 thus permitting clock pulses on line 37 to count the counter 10 in a relatively rapid fashion in comparison to the counting accomplished through the circuit 16. The switch group 18B is set in a predetermined state corresponding to a particular count representative of a predetermined vend period. When the binary counter attains a state wherein all inputs to the gate 60 are high then there is a low level signal on line 93 which functions as a reset signal for discharging capacitor C9 through diode D5 and causing a reset of the flip-flops 70 and 85 and the binary counter 10. The resetting of flip-flop 70 causes the output on line 72 to go low thus disabling gate 74 and causing transistor Q1 to cease conduction. This interrupts all power to the load from the triac circuit 75 and signals a termination of the vend period.

The circuit of this invention also has the capability of interrupting the vend period, preferably by manual means illustratively shown by the box 96. Normally, the output of box 96 is a high level signal on line 68 which enables gate 74. Box 96 may comprise a switch that puts either a high level or low level signal on line 68. For some applications it is desirable to interrupt the vending period before the set end thereof. For example, if one is vending hot chocolate or the like, it may be desirable to end the period early if the product is foaming. The circuit is arranged so that the line 68 is normally high permitting continuation of the vend period but may be selectively moved to its low state by switch operation by the operator of the vending machine so as to inhibit gate 74 and thus interrupt the power to the load. However, during this interruption the counter continues counting so that at the end of the preselected time period all operation is reset as previously explained.

What is claimed is:

1. Timer circuit for a vending machine comprising;

a counter having first and second counter sections, one for demarcating coinage and another for demarcating vend period, said counter having input means for counting the counter and output lines corresponding to the sections thereof, means responsive to coinage for generating at least one count signal coupled to the input means of the counter to count the first section of the counter, circuit means for operating a load during the vend period, first settable decoder means coupled from output lines of the first section of the counter for providing a signal coupled to said circuit means for initiating the vend period of the circuit means, said counter input means including gate means receiving at least said one count signal coupling to the clock input of the counter, means for generating clock signals (coupled) for selective coupling to the gate means and in turn to the counter to count the second section of the counter, means responsive to said first settable decoder means and the vend period initiation signal therefrom for permitting the passage of the clock signals to the counter input means, and second settable decoder means coupled from output lines of the second section for providing a signal terminating the vend period of the circuit means.

2. A timer circuit as set forth in claim 1 wherein said counter is a binary counter having the least significant bit output lines coupling to the first settable decoder and the most significant bit output lines coupling to the second settable decoder.

3. A timer circuit as set forth in claim 1 wherein said settable decoders include, respectively, first and second switch means and first and second decoder gate means, said first switch means for setting the coin denomination for operation of the machine and said second switch means for setting the duration of the vend period.

4. A timer circuit as set forth in claim 3 wherein each switch means has a number of switches corresponding to the number of output lines from the counter.

5. A timer circuit as set forth in claim 1 including means intercoupling the output of the first decoder with the circuit means including a bistable device set to initiate the vend period and means responsive to the output of the second decoder for resetting the bistable device to terminate the vend period.

6. A timer circuit as set forth in claim 5 wherein said circuit means includes an AC operated electronic switch.

7. A timer circuit as set forth in claim 1 wherein said means responsive to coinage includes means responsive to coins of at least two different denominations, including first and second coin responsive circuits.

8. A timer circuit as set forth in claim 7 including means intercoupling the first and second coin responsive circuits for generating spaced pulses in both circuits in response to coinage of the larger denomination.

9. A timer circuit as set forth in claim 8 wherein said means intercoupling includes a uni-directional electronic means.

10. A timer circuit as set forth in claim 1 including means coupled from the second settable decoder means for resetting at least the counter.

11. A timer circuit as set forth in claim 10 wherein the means for resetting includes power-up reset means.

12. A timer circuit as set forth in claim 1 including means for inhibiting signals from the means responsive to coinage after the proper coinage amount has been received.

13. A timer circuit as set forth in claim 1 wherein said means for generating clock signals includes a source of pulse signals coupled to an enable gate which is only enabled after registration of the proper coinage to count the second counter section through the vend period.

14. A timer circuit as set forth in claim 13 wherein said gate means of the counter input means includes an AND type gate having one count signal path receiving the coinage count signal and at least a second path receiving the pulse signals.

15. A timer circuit as set forth in claim 14 wherein the circuit means includes a bistable device set to initiate the vend period and means responsive to the output of the second settable decoder means for resetting the bistable device to terminate the vend period and disable said enable gate to end the pulse signals.

16. A timer circuit as set forth in claim 15 including means responsive to said first settable decoder means for inhibiting further coinage count signals when the decoder means is satisfied indicating proper coinage amount.

17. A timer circuit for a vending machine comprising;

a counter having first and second counter sections, said counter having input means for counting the counter and output lines corresponding to the sections thereof, means responsive to coinage for generating a signal coupled to the input means of the counter to count the counter, circuit means for operating a load during a vend period, first settable decoder means coupled from output lines of the first section of the counter for providing a signal for initiating the vend period of the circuit means, second settable decoder means coupled from output lines of the second section of the counter for providing a signal terminating the vend period of the circuit means, and means for selectably manually interrupting the vend period by inhibiting operation of the circuit means associated with the load.

18. Timer circuit for a vending machine comprising;

a counter having first and second counter sections, one for demarcating coinage and another for demarcating vend period, said counter having input means for counting the counter and output lines corresponding to the sections thereof, means responsive to coinage for generating at least one count signal coupled to the input means of the counter to count the first section of the counter, circuit means for operating a load during the vend period, first settable decoder means coupled from output lines of the first section of the counter for providing a signal coupled to said circuit means for initiating the vend period of the circuit means, said counter input means including means defining a signal clock input line and said counter sections being contiguous with the counter being counted at the single clock input line to progress from the first to the second sections of the counter, means for generating clock signals for selective coupling to the counter clock input line to count the counter, means responsive to said first settable decoder means for permitting the clock signals to pass to said counter, and second settable decoder means coupled from output lines of the second section of the counter for providing a signal terminating the vend period of the circuit eans.

* * * * *